US012778325B2

(12) United States Patent
Winebarger et al.

(10) Patent No.: US 12,778,325 B2
(45) Date of Patent: Nov. 3, 2026

(54) LAYERABLE BEDDING SYSTEM

(71) Applicant: Attached Sleep LLC, Cerritos, CA (US)

(72) Inventors: Lisa Winebarger, Cerritos, CA (US); Vicky Chien, Cerritos, CA (US)

(73) Assignee: Attached Sleep LLC, Cerritos, CA (US)

( * ) Notice: Subject to any disclaimer, the term of this patent is extended or adjusted under 35 U.S.C. 154(b) by 0 days.

(21) Appl. No.: 18/893,299

(22) Filed: Sep. 23, 2024

(65) Prior Publication Data

US 2026/0083263 A1 Mar. 26, 2026

(51) Int. Cl.
*A47G 9/02* (2006.01)

(52) U.S. Cl.
CPC ..... *A47G 9/0246* (2013.01)

(58) Field of Classification Search
CPC ... A47C 21/022; A47C 27/002; A47C 31/105; A47C 27/15; A47G 9/0246; A47G 9/02; A47G 9/0238
USPC ..... 5/496, 498, 502
See application file for complete search history.

(56) References Cited

U.S. PATENT DOCUMENTS

| | | | | |
|---|---|---|---|---|
| 3,857,124 | A * | 12/1974 | Hadley | A47G 9/02 5/494 |
| 5,666,680 | A * | 9/1997 | Hackett, Jr. | A47C 31/105 5/692 |
| 5,732,424 | A | 3/1998 | Bond | |
| 6,098,219 | A * | 8/2000 | Milber | A47C 21/022 5/494 |
| 2013/0139316 | A1* | 6/2013 | Rabbany | A47C 31/105 29/428 |
| 2016/0353907 | A1* | 12/2016 | Lava | A47C 27/002 |
| 2020/0288888 | A1 | 9/2020 | Doshi et al. | |
| 2023/0013670 | A1* | 1/2023 | Pfister | A47G 9/0238 |

* cited by examiner

*Primary Examiner* — Justin C Mikowski
*Assistant Examiner* — George Samuel Gines
(74) *Attorney, Agent, or Firm* — Shih IP Law Group, PLLC

(57) ABSTRACT

A layerable bedding system may include a base layer and one or more sheets. The base layer and one or more sheets may each include fastening mechanisms for removably attaching one or more sheets to the base layer. Removing the top sheet on the base layer may uncover a clean sheet under the top sheet.

20 Claims, 13 Drawing Sheets

LAYERABLE BEDDING SYSTEM

TECHNICAL FIELD

The present disclosure relates to a layerable bedding system for efficient and convenient installation and removal of bedding layers.

BACKGROUND

Most people sleep on mattresses, which are large, heavy, and expensive products that are difficult to clean. To protect their mattresses from oils, sweat, dust, and dander, as well as accidents, spills, and stains, people commonly use bedding products like fitted sheets. However, since most fitted sheets are not waterproof, many individuals also use a waterproof mattress cover underneath the fitted sheet. This combination may offer both mattress protection and a comfortable sleeping surface.

Despite their widespread use, conventional mattress protectors and fitted sheets may have notable limitations. Regular maintenance, such as installing, removing, and reapplying these products, may be challenging and inconvenient due to the size and weight of mattresses. The process of properly fitting a mattress cover and fitted sheet typically involves several cumbersome steps:

Unfolding and Orienting: Unfolding the mattress cover and determining its short and long edges can be difficult due to the elastic borders.

Aligning and Securing: Aligning the cover with the mattress and securing each corner by tucking the elastic under the mattress often requires partial lifting of the mattress.

Stretching and Adjusting: Repeating the alignment and securing process for all four corners may be required until the cover is fully installed.

Repeating with the Fitted Sheet: Installing a fitted sheet on top of the mattress cover can be more challenging due to the added bulk of the cover.

When soiling occurs, such as from a child's nighttime accident, both the fitted sheet and the waterproof mattress cover may be removed for cleaning. This process can be labor-intensive, requiring access to all four mattress corners. Additionally, laundering both items may demand significant space, energy, water, and detergent. After washing, the entire installation process may be repeated.

The difficulties of the installation, removal, laundering, and reinstallation process may be especially burdensome for those who need to change their bedding frequently, such as individuals sharing a bed with children or pets, those dealing with incontinence or other health issues, or those with heavy menstruation. The challenge may be further compounded for people with physical limitations, such as reduced strength or mobility, or those whose bed placement makes access to mattress corners difficult.

There is a clear need for an integrated bedding system that provides effective mattress protection while also:

- Eliminating the need for frequent, full-scale bedding changes.
- Simplifying the removal of soiled sheets.
- Reducing the amount of bedding that needs laundering.
- Reducing the reliance on disposable products for mattress protection.
- Easing the reinstallation of clean sheets.

SUMMARY

A layerable bedding system may include a base layer and two or more tracks of fastening members on the base layer.

The base layer may have a top surface on a top side of the base layer, at least one lateral surface connected to the top surface and extending downwardly from the top surface, and a bottom side positioned opposite from the top side. The base layer may be configured to removably attach to one or more sheets from the top side of the base layer while remaining installed on the mattress. The two or more tracks of fastening members may each be disposed on either the top surface or the at least one lateral surface of the base layer. The two or more tracks of fastening members may include a first track of an engaging component and a second track of a receiving component. Either each of the first track of the engaging component and the second track of the receiving component may be configured to mate with different sheets positioned on the top side of the base layer or both the first track of the engaging component and the second track of the receiving component may be configured to mate with a single sheet positioned on the top side of the base layer.

A bedding system may include a first sheet and two or more tracks of fastening members on the first sheet. The first sheet may have a top surface located on a top side of the first sheet, a bottom surface located on a bottom side of the first sheet and positioned opposite from the top surface, and at least one lateral surface interposed between the top surface and the bottom surface. The first sheet may be configured to removably attach to a base layer from the bottom side of the first sheet. The two or more tracks of fastening members may each be disposed on either the top surface, the bottom surface, or the at least one lateral surface of the first sheet. The two or more tracks of fastening members may include a first track of an engaging component configured to mate with a second sheet from a top side of the first sheet or a base layer from the bottom side of the first sheet and a second track of a receiving component configured to mate with a base layer from the bottom side of the first sheet.

A bedding system may include a base layer, a first sheet, and a second sheet, each of which may have at least two tracks of fastening members.

The base layer may have a top surface located on a top side of the base layer, at least one lateral surface connected to the top surface of the base layer and extending downwardly from the top surface of the base layer, and a bottom side positioned opposite from the top side of the base layer. Two or more tracks of fastening members may each be disposed on either the top surface or the at least one lateral surface of the base layer.

The first sheet may have a top surface on a top side of the first sheet, a bottom surface located on a bottom side of the first sheet and positioned opposite from the top surface of the first sheet, and at least one lateral surface interposed between the top surface and the bottom surface of the first sheet. Two or more tracks of fastening members may each be disposed on either the top surface, the bottom surface, or the at least one lateral surface of the first sheet.

The second sheet may have a top surface located on a top side of the second sheet, a bottom surface located on a bottom side of the second sheet and positioned opposite from the top surface of the second sheet, and at least one lateral surface interposed between the top surface and the bottom surface of the second sheet. Two or more tracks of fastening members may each be disposed on either the top surface, the bottom surface, or the at least one lateral surface of the second sheet.

The base layer may be configured to removably attach to the first sheet, the second sheet, or both the first sheet and the second sheet from the top side of the base layer. The first sheet may be configured to removably attach to a base layer from the bottom side of the first sheet and a second sheet from the top side of the first sheet. The second sheet may be configured to removably attach to the first sheet from the bottom side of the second sheet and either a third sheet from the top side of the second sheet or the base layer from the bottom side of the second sheet.

BRIEF DESCRIPTION OF THE DRAWINGS

The disclosure can be understood in consideration of the following detailed description of various embodiments in connection with the accompanying drawings.

DETAILED DESCRIPTION

Figure 1:
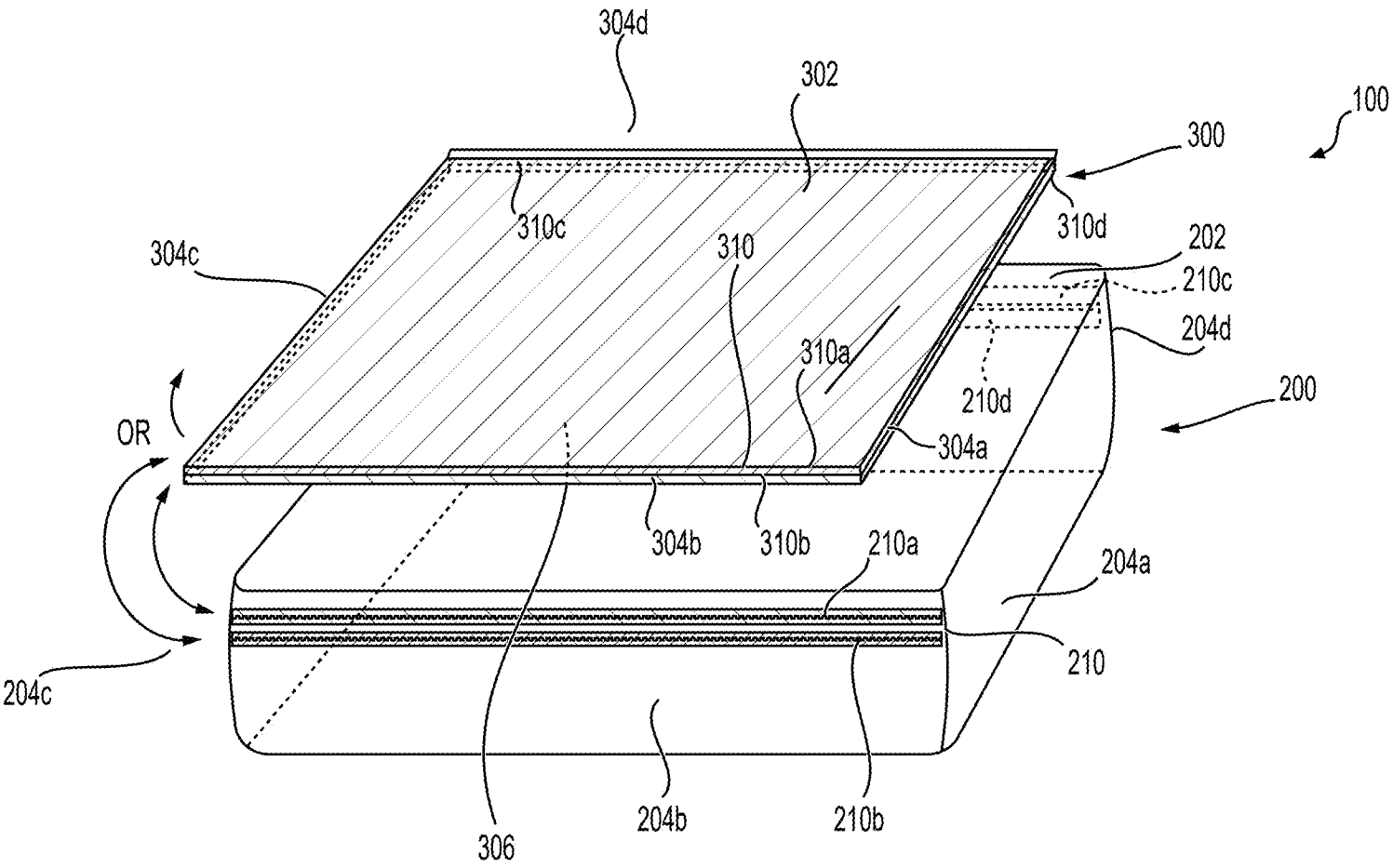
FIG. 1 is an exploded view of an example bedding system with a base layer and a sheet.

To solve the problems of existing bedding systems, the present disclosure provides a layerable bedding system for ease and speed of installation and removal. The layerable bedding system may include a base and layerable sheets. The base may provide the foundational layer upon which a desired number of sheets can be layered. The base may be a mattress cover, a fitted sheet, or a mattress. As a mattress, the base may be relatively stationary. As a mattress cover or fitted sheet, the base may be considered stationary once it is secured onto the mattress. As a mattress or a mattress cover or fitted sheet secured onto the mattress, the base may be considered stationary relative to the layerable sheets. The base may stay in place or be stationary, and layerable sheets may be applied to the base. Any of the mattress cover, fitted sheet, or layerable sheet may be waterproof. The layerable sheets may be secured to the base layer by any suitable fastening mechanism, such as a zipper. The bedding system can accommodate any number of sheets.

The bedding system's core benefits include:

Soiled sheets can easily be removed to reveal a clean sheet layer from underneath, obviating the need for a full bedding change each time the sheet in use is soiled.

After a soiled sheet is removed, users can immediately resume use of their bed on a clean sheet layer without applying a new sheet.

Reinstallation of clean sheets may be significantly eased and simplified compared with other bedding systems, since a clean sheet can be attached to the bedding system by a fastening mechanism along the sheet's surface perimeter and does not require access to the underside of mattress corners.

With sufficient layering, users can avoid ever having to reinstall fitted coverings around mattress corners after the initial installation of the base.

Any topmost sheet may be secured directly to the base to increase surface tension, if desired.

The overall volume of bedding to be laundered, and the associated resources required to wash them, may be reduced significantly.

For purposes of promoting an understanding of the principles of the disclosure, reference will now be made to the embodiments illustrated in the drawings, and specific language will be used to describe the same. It will nonetheless be understood that no limitation of the scope of the disclosure is intended by the illustration and description of certain embodiments of the disclosure. In addition, any alterations and/or modifications of the illustrated and/or described embodiment(s) are contemplated as being within the scope of the present disclosure. Further, any other applications of the principles of the disclosure, as illustrated and/or described herein, as would normally occur to one skilled in the art to which the disclosure pertains, are contemplated as being within the scope of the present disclosure.

FIG. 1 is an exploded view of an example bedding system with a base layer and a sheet. The bedding system 100 may include a base layer 200 and a first sheet 300. The base layer 200 may have a fastening mechanism 210 for attaching to or detaching from other layers, such as first sheet 300. The first sheet 300 may have a fastening mechanism 310 for attaching to or detaching from other layers, such as base layer 200 or other sheets, such as a second sheet.

The fastening mechanism 210 of base layer 200 may include two tracks of fastening components 210*a*, 210*b* that cooperate with the fastening mechanisms of other sheets, such as the fastening mechanism 310 of the first sheet 300. The fastening mechanism 310 of first sheet 300 may include two tracks of fastening components 310*a*, 310*b* that cooperate with the fastening mechanisms of other layers or sheets, such as the fastening mechanism 210 of base layer 200 or the fastening mechanism of a third sheet, etc.

The base layer 200 has a top surface 202 and lateral surfaces, such as 204*a*, 204*b*, 204*c*, 204*d*, connecting at the perimeter of the top surface 202 and extending downwardly from the top surface 202. The connection between the top surface and a lateral surface defines an edge. The connection between two lateral surfaces defines a corner. The base layer 200 may be a mattress cover or a fitted sheet, such that the bottom surface of the base layer 200 is open or exposed. In some examples, the base layer is a mattress, such that the bottom surface is positioned opposite from the top surface with lateral surfaces interposed between the top surface and the bottom surface.

The fastening mechanism 210 of the base layer 200 may be disposed on at least one of the lateral surfaces, such as 204*b*, or top surface 202 of the base layer, which may provide easy access to a user to attach or detach sheets. The two tracks of fastening components 210*a*, 210*b* may be disposed on a portion of the lateral surface that is closer to the top surface or top side of the base layer. The two tracks of fastening components 210*a*, 210*b* may be disposed on the longest lateral surface. In some examples, the two tracks of fastening components 210*a*, 210*b* may be disposed on the shortest lateral surface. In some examples, the two tracks of fastening components 210*a*, 210*b* of the base layer 200 may be disposed on the lateral surface 204*b* and another two tracks of fastening components 210*c*, 210*d* of the base layer may be disposed on the lateral surface 204*d* that is opposite from the lateral surface 204*b* to securely attach to one or more sheets. The lengths of the lateral surface 204*b* and 204*d* may be greater than the lengths of the lateral surface 204*a* and 204*c* so there is more surface area attachment between the base layer and one or more sheets than if the two tracks of fastening components were disposed on the shorter length lateral surfaces 204*a*, 204*c*. In some examples, two tracks of fastening components may be disposed on each of the lateral surfaces of the base layer. In some examples, two tracks of fastening components may be disposed continuously on all the lateral surfaces along the perimeter of the top surface. In some examples, the two tracks of fastening components may be disposed on the top surface along the perimeter of the base layer near the lateral surface. In some examples, one track of the two tracks of fastening components may be disposed on the top surface along the inner edge or perimeter of the base layer and one track of the two tracks of fastening components may be disposed on the lateral surface of the base layer near the top surface of the base layer. In some examples, the tracks of fastening components are parallel to each other.

The first sheet 300 has a top surface 302, bottom surface 306, and lateral surfaces, such as 304*a*, 304*b*, 304*c*, 304*d*, interposed between the top surface 302 and the bottom surface 306. The lateral surfaces connect at the perimeter of the top surface 302 and extend downwardly from the top surface 302. The connection between the top surface and a lateral surface defines an edge. The connection between two lateral surfaces defines a corner.

The fastening mechanism 310 of the first sheet 300 may be disposed on at least one of the lateral surfaces, such as 304*b*, top surface 302, or bottom surface 306 of the first sheet. The two tracks of fastening components 310*a*, 310*b* may be disposed on the longest lateral surface. In some examples, the two tracks of fastening components 310*a*, 310*b* may be disposed on the shortest lateral surface. In some examples, the two tracks of fastening components 310*a*, 310*b* of the base layer 200 may be disposed on the lateral surface 304*b* and another two tracks of fastening components 310*c*, 310*d* of the first sheet 300 may be disposed on the lateral surface 304*d* that is opposite from the lateral surface 304*b* to securely attach to the base layer 200 or an additional sheet. The lengths of the lateral surface 304*b* and 304*d* may be greater than the lengths of the lateral surface 304*a* and 304*c* so there is more surface area attachment between the first sheet and the base layer and/or an additional sheet than if the two tracks of fastening components were disposed on the shorter length lateral surfaces 304*a*, 304*c*. In some examples, two tracks of fastening components may be disposed on each of the lateral surfaces of the first sheet. In some examples, two tracks of fastening components may be disposed continuously on all the lateral surfaces along the perimeter of the top surface of the first sheet. In some examples, the two tracks of fastening components may be disposed on the top surface along the perimeter of the first sheet near the lateral surface. In some examples, one track of the two tracks of fastening components may be disposed on the top surface along the inner edge or the perimeter of the first sheet and one track of the two tracks of fastening components may be disposed on the lateral surface of the first sheet near the top surface of the first sheet. In some examples, one track of the two tracks of fastening components may be disposed on or near the edge between the top surface and a lateral surface of the first sheet and the other track of the two tracks of fastening components may be disposed on or near the edge between the bottom surface and the same lateral surface of the first sheet. In some examples, the tracks of fastening components are parallel to each other.

One of the two tracks of the fastening components of the fastening mechanism of the base layer or the first sheet may be an engaging component (e.g., first engaging component) and the other of the two tracks of the fastening components of the fastening mechanism of the base layer or the first sheet may be a receiving component (e.g., first receiving component). The two tracks of the first engaging component and the first receiving component may interact (e.g., interlock) with a receiving component and an engaging component, respectively, of a different layer or sheet. The engaging component may engage with the receiving component, and the receiving component may receive the engaging component to interlock with each other. The engaging component may be a male part, and the receiving component may be a female part.

Referring to FIG. 1, in the two tracks of a fastening mechanism 210 on the base layer 200, the first track of the engaging component 210*a* may be positioned closer to the top surface 202 than the second track of the receiving component 210*b*. The first track of the engaging component 210*a* may be positioned above the second track of the receiving component 210*b*. In the two tracks of a fastening mechanism 310 on the first sheet 300, the first track of the engaging component 310*a* may be positioned closer to the top surface 302 than the second track of the receiving component 310*b*. The first track of the engaging component 310*a* may be positioned above the second track of the receiving component 310*b*.

The fastening mechanism may be any suitable fastener for fastening any combination or number of bedding layers or sheets, such as a zipper, magnetic fastener, snap fastener, hook and loop fastener, button and buttonhole fastener, buckle, tension fastener, twist-lock fastener, cam lock, latching mechanism, rivet, etc. In some examples, the fastening mechanism is a hook and loop fastener, the engaging component may be the hook side for hooking or catching, and the receiving component may be the loop side that receives the hooks. In some examples, the fastening mechanism is a magnetic fastener, the engaging component is a magnet or magnetic strip, and the receiving component is a ferromagnetic material or an opposite magnet so that the engaging component and the receiving component attract and fasten with each other. In some examples, the fastening mechanism is a snap fastener, the engaging component may be the male part or stud that snaps into the other part, and the receiving component may be the other part or the female part or socket that receives the male part or stud.

Figure 2:
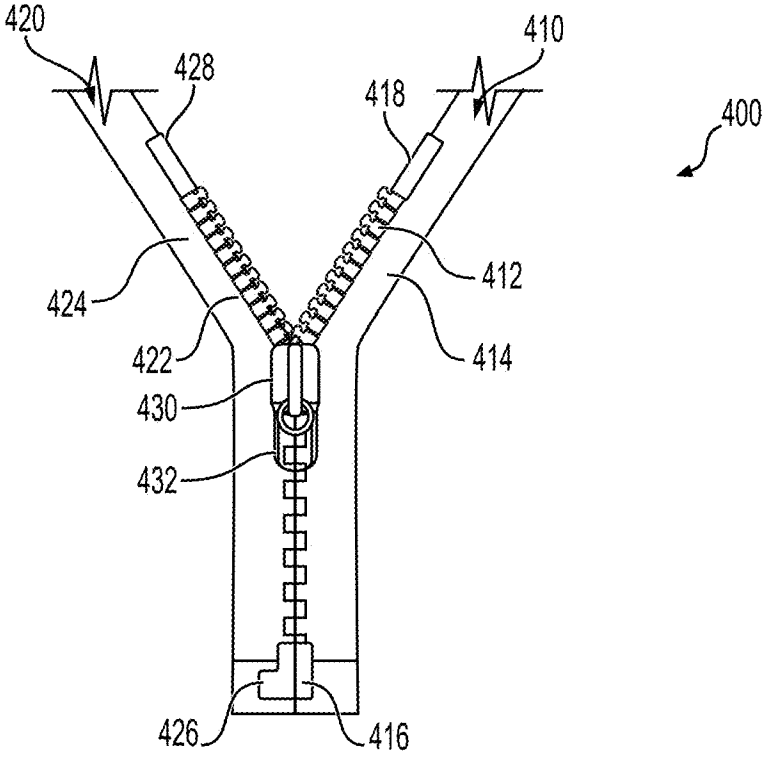
FIG. 2 is a schematic view of an example fastening mechanism.

FIG. 2 is a schematic view of an example fastening mechanism. In some examples, the fastening mechanism may be a zipper 400, the engaging component 410 may include zipper teeth or elements 412 on a tape 414, and the receiving component 420 may include complementary zipper teeth or elements 422 on another tape 424 that interlock with the engaging component's zipper teeth or elements 412. The engaging component 410 may include an insertion pin 416, and the receiving component 420 may include a retainer box 426. The slider 430 may be positioned on the tape with the retainer box 426. A pull tab 432 may be attached to the slider 430 to provide a user with a means of manually operating the slider 430. Stops 418, 428 may be positioned at the ends of the tapes 410, 420 that is opposite from the ends with insertion pin 416 and retainer box 426.

To close the zipper, the insertion pin 416 is inserted into the retainer box 426, ensuring that the two sides of the zipper are aligned. When the insertion pin 416 is securely in place, the slider 430 may be moved along the tapes from the direction of the tape ends with the insertion pin 416 and retainer box 426 to the tape ends with the stops 418, 428 using the pull tab 432. As the slider 430 moves along the teeth 412, 422, the internal wedging mechanism of the slider 430 forces the teeth 412, 422 from both sides to interlock, effectively closing the zipper.

To open the zipper, the pull tab 430 may be moved along the tapes from the direction of the open ends (e.g., the tape ends with stops 418, 428) to the closed end (e.g., the tape ends with insertion pin 416, 426) using the pull tab 432, causing the slider 430 to disengage the teeth by separating them as it moves along the length of the zipper. Once the slider 430 reaches the ends of the tape having the insertion pin 416 and the retainer box 426, the insertion pin 416 can be removed from the retainer box 426, fully separating the two sides of the zipper.

Figure 3:
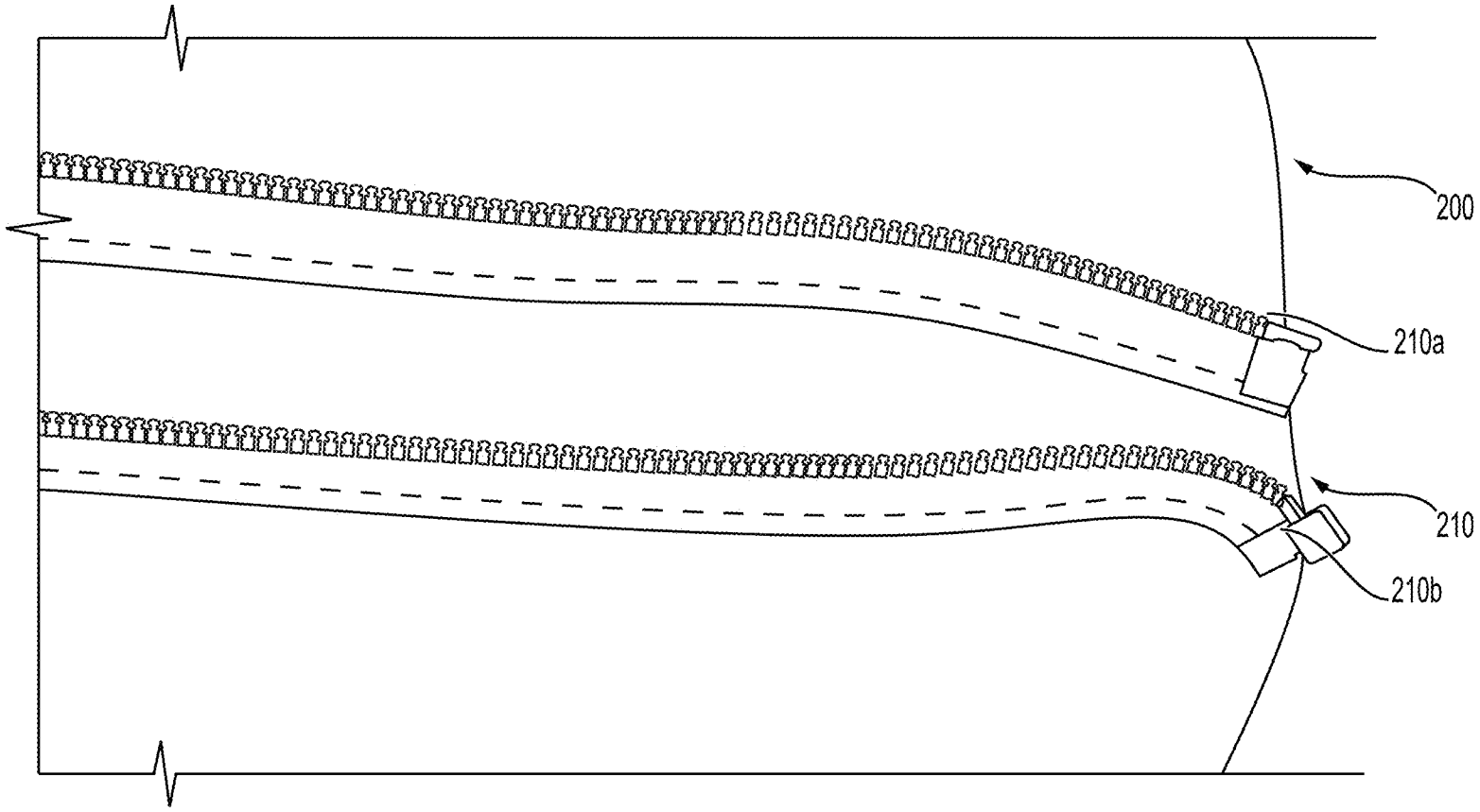
FIG. 3 is a view of an example base layer with fastening mechanisms, such as zipper components.

FIG. 3 is a view of an example base layer with zipper components. The first track of the first engaging component 210*a* and the second track of the receiving component 210*b* of the fastening mechanism 210 may be disposed on a lateral surface of the base layer 200. One of the tracks, such as the first track of the first engaging component 210*a*, may be disposed near or on the edge between a lateral surface and the top surface 202, and the other track may be disposed further away from the edge between the lateral surface and the top surface 202 or closer to the bottom side of the base layer 200. In some examples, the ends of the tracks where the insertion pin 416 and retainer box 426 are disposed may be positioned near the edge (e.g., elastic corner) where two lateral surfaces meet. The tracks may be secured to the lateral surface by suitable means, such as sewing. The side of each of the tapes without teeth may be secured to the lateral surface. The tracks or tape on the same base layer may be positioned orthogonal to the lateral surface, such that the teeth of each tape or track are in a parallel arrangement on different planes rather than in a planar interlocking arrangement, where the teeth of each tape or track face each other for interlocking. The two tracks or tapes may be non-coplanar or may lie on different planes. The teeth of the two tracks or tapes may be non-coplanar or may lie on different planes. Each of the two tapes lies on different planes, and their respective teeth lie on different planes. The two tracks or tapes may be positioned so their respective teeth may not engage with each other.

Figure 4:
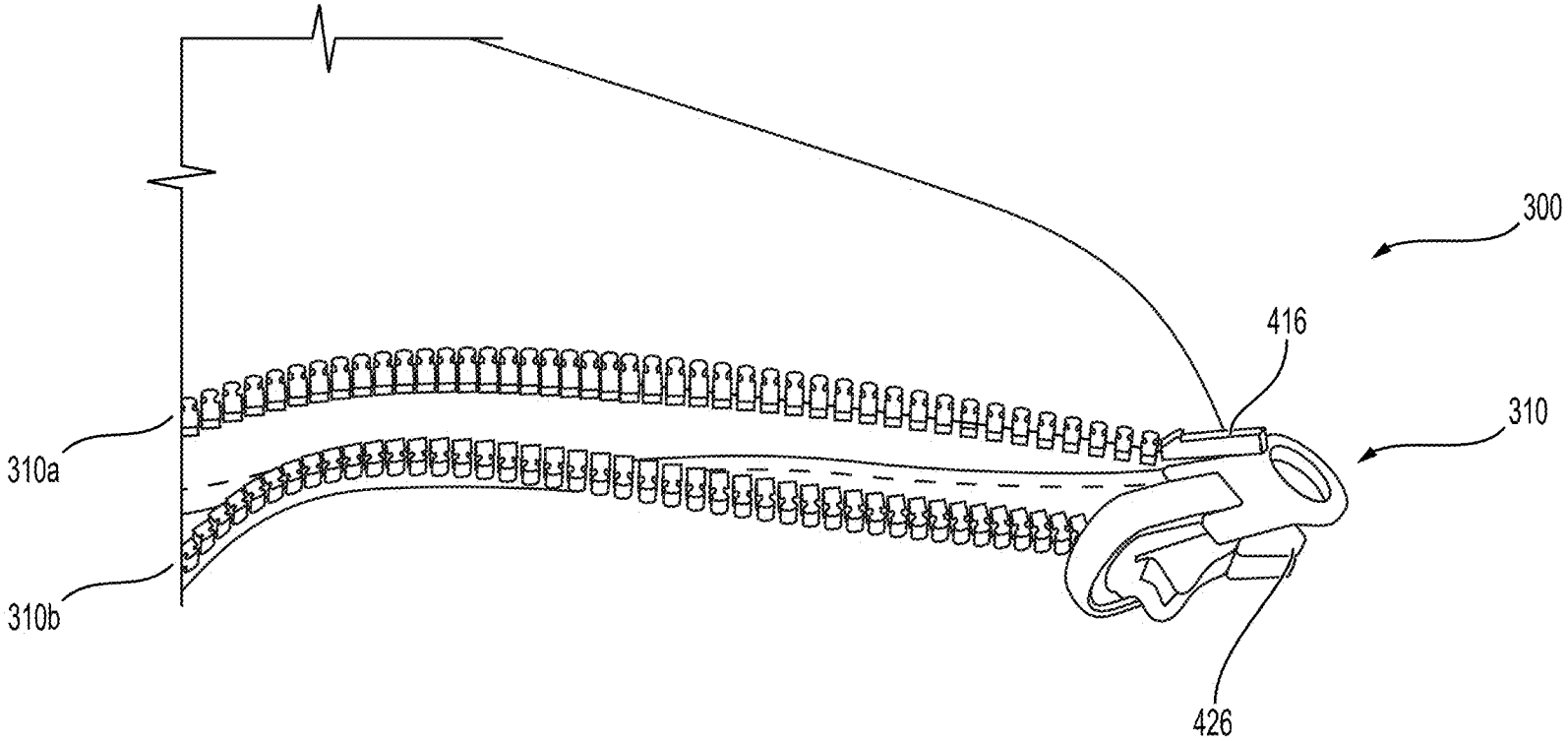
FIG. 4 is a view of an example first sheet with zipper components for attaching to a base layer.

FIG. 4 is a view of an example sheet with zipper components for attaching to a base layer. The first sheet 300 may be detached from the base layer 200. The fastening mechanism 310 may include the first track of the engaging component 310*a* and the second track of the receiving component 310*b* disposed on the edge of the first sheet 300. The insertion pin 416 and the retainer box 426 may be positioned on either end of the two tracks as long as they are on the same end. FIG. 4 shows the insertion pin 416 and the retainer box 426 on a different end of the two tracks than in FIG. 1. The zipper may move from right to left to close the zipper (e.g., fasten two layers together) as shown in FIG. 4 or left to right to close the zipper as shown in FIG. 1. The zipper may move from left to right to open the zipper (e.g., detach two layers from each other) as shown in FIG. 4 or right to left to open the zipper as shown in FIG. 1.

The first track of the engaging component 310*a* and the second track of the receiving component 310*b* of the fastening mechanism 310 may be disposed on a lateral surface of the first sheet 300. One of the tracks, such as the first track of the engaging component 310*a*, may be disposed near or on the edge between a lateral surface and the top surface 302, and the other track 310*b* may be disposed beneath the first track between the lateral surface and the bottom surface 306 of the first sheet 300. The first track of the engaging component 310*a* may be positioned further away from the bottom surface, and the second track of the receiving component 310*b* may be positioned further away from the top surface. In some examples, the ends of the tracks where the insertion pin 416 and retainer box 426 are disposed may be positioned near the edge where two lateral surfaces meet. The tracks may be secured to the lateral surface by suitable means, such as sewing. The side of each of the tapes without teeth may be secured to the lateral surface. The tracks or tape on the same first sheet may be positioned orthogonal to the lateral surface, such that the teeth of each tape or track are in a parallel arrangement on different planes rather than in a planar interlocking arrangement, where the teeth of each tape or track face each other for interlocking. The two tracks or tapes may not be non-coplanar. The teeth of the two tracks or tapes may be non-coplanar.

For attaching to the base layer 200, the pull tab 432 may be operated to pull the slider 430 along the tape so that the first track of the engaging component 310*b* of the first sheet 300 engages with the second track of the receiving component 210*b*. The slider may be a reversible slider that can move in both directions along the zipper track. The reversible slider may have a pull tab that can flip over or rotate.

The sheet may be a single layer of material having a suitable thickness for two tracks of fastening mechanism (e.g., zippers) to be fastened by methods, such as sewing. The sheet may be formed by securing two zipper tracks between two sheets or between the open ends of a folded sheet. The sheet may also be formed by securing each of the two zipper tracks on opposite ends of a sheet, folding the sheet to align the tracks, and securing the tracks to each other. Securing may be accomplished by suitable means, such as sewing.

Figure 5:
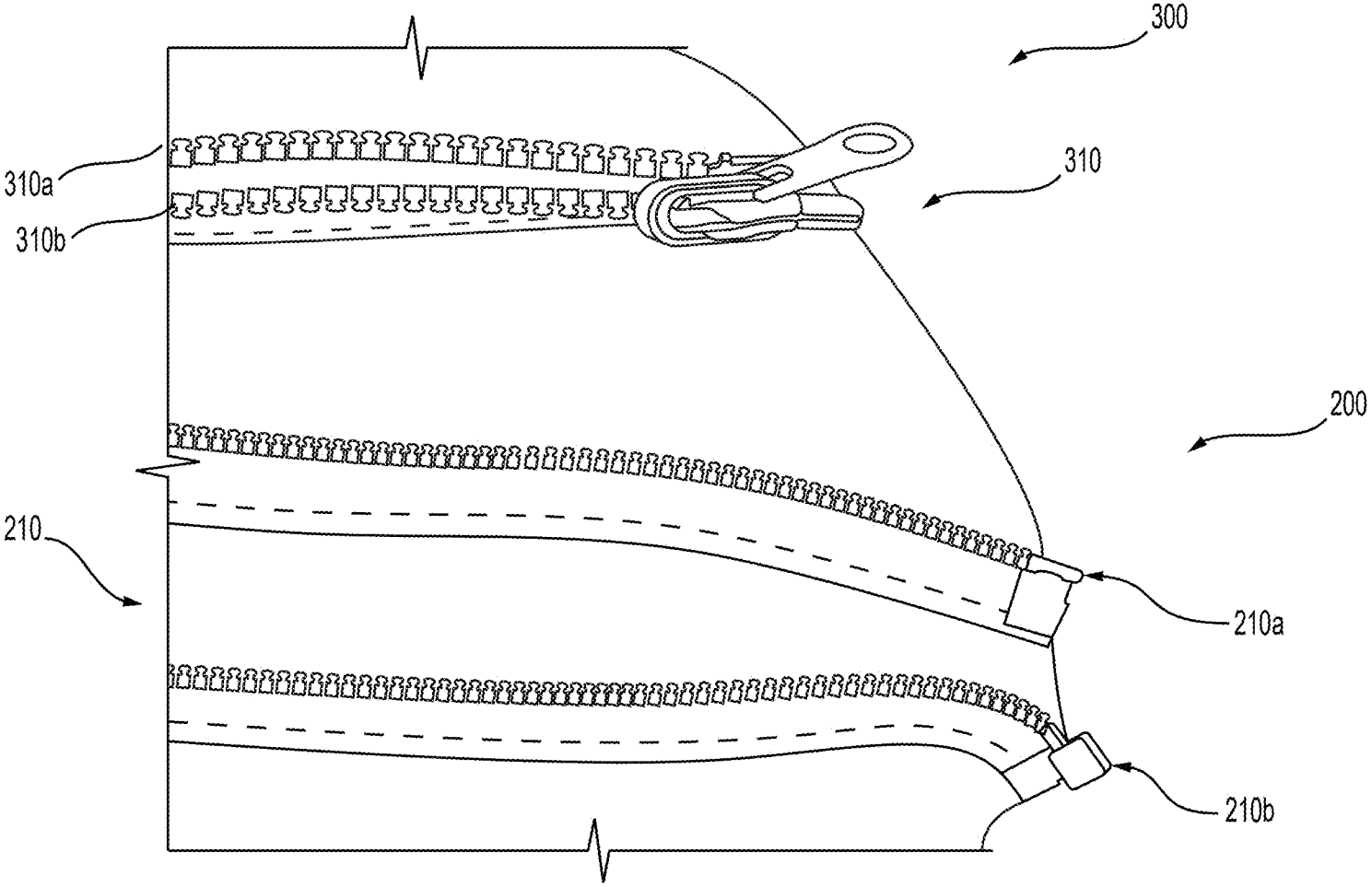
FIG. 5 is an example bedding system with a sheet detached from a base layer.

FIG. 5 is an example bedding system with a sheet detached from a base layer. The first sheet 300 may be detached from the base layer 200. Both the base layer 200 and the first sheet 300 may each have two tracks. The four tracks or tape may be positioned orthogonal to their respective lateral surface, such that the teeth of each tape or track are in a parallel arrangement on different planes rather than in a planar interlocking arrangement, where the teeth of each tape or track face each other for interlocking. The four tracks or tapes may not be non-coplanar. The teeth of the four tracks or tapes may be non-coplanar.

Figure 6:
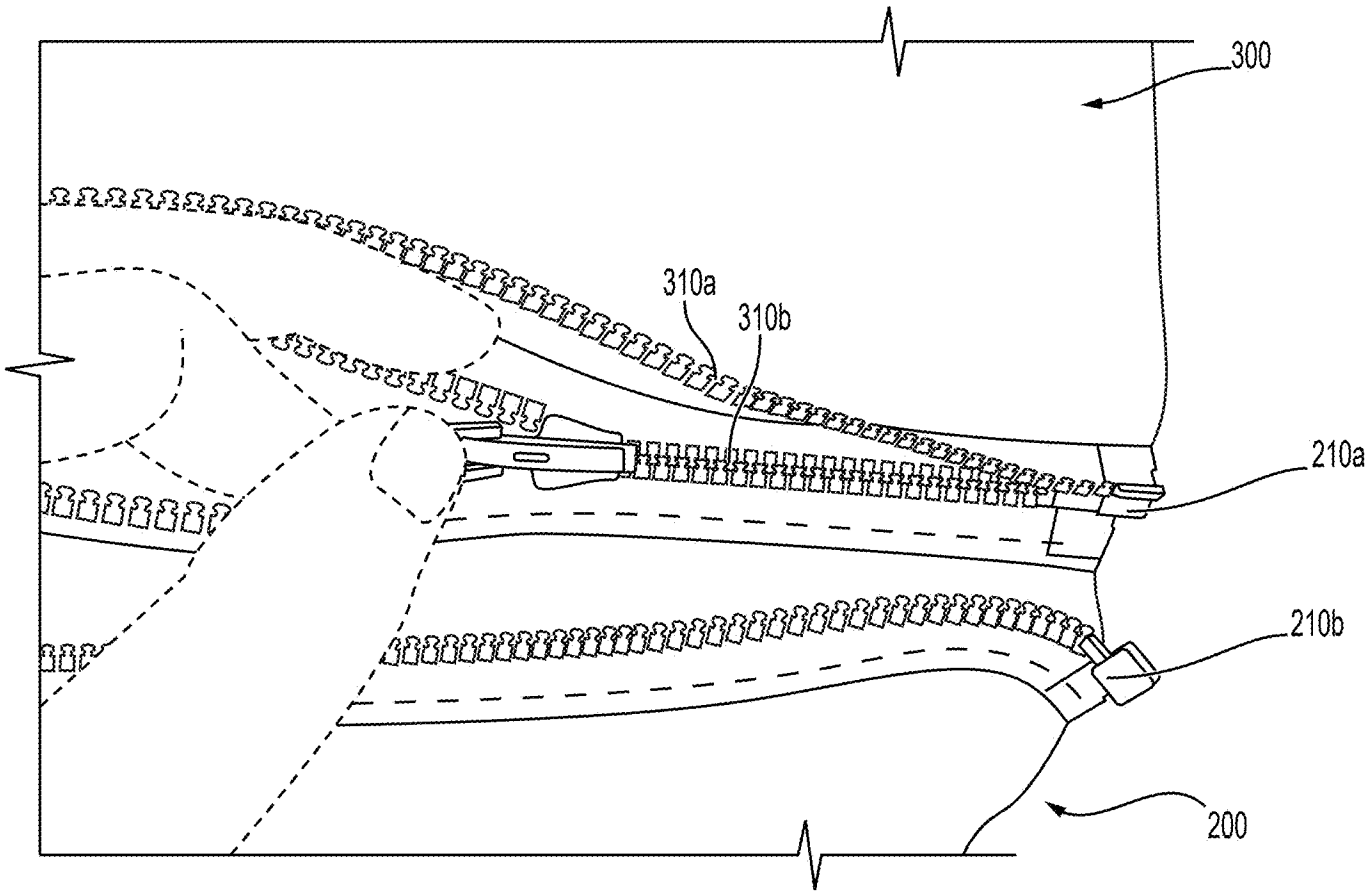
FIG. 6 is an example bedding system with one fastening component track of a sheet partially attached to one fastening component track of a base layer.

FIG. 6 is an example bedding system with one fastening component track of a sheet partially attached to one fastening component track of a base layer. The first sheet 300 may be attached to the base layer 200. The first track of the engaging component 210*a* (e.g., male zipper track) of the base layer 200 may engage with the second track of the receiving component 310*b* (e.g., female zipper track) of the first sheet 300 to attach the first sheet 300 with the base layer 200.

Figure 7:
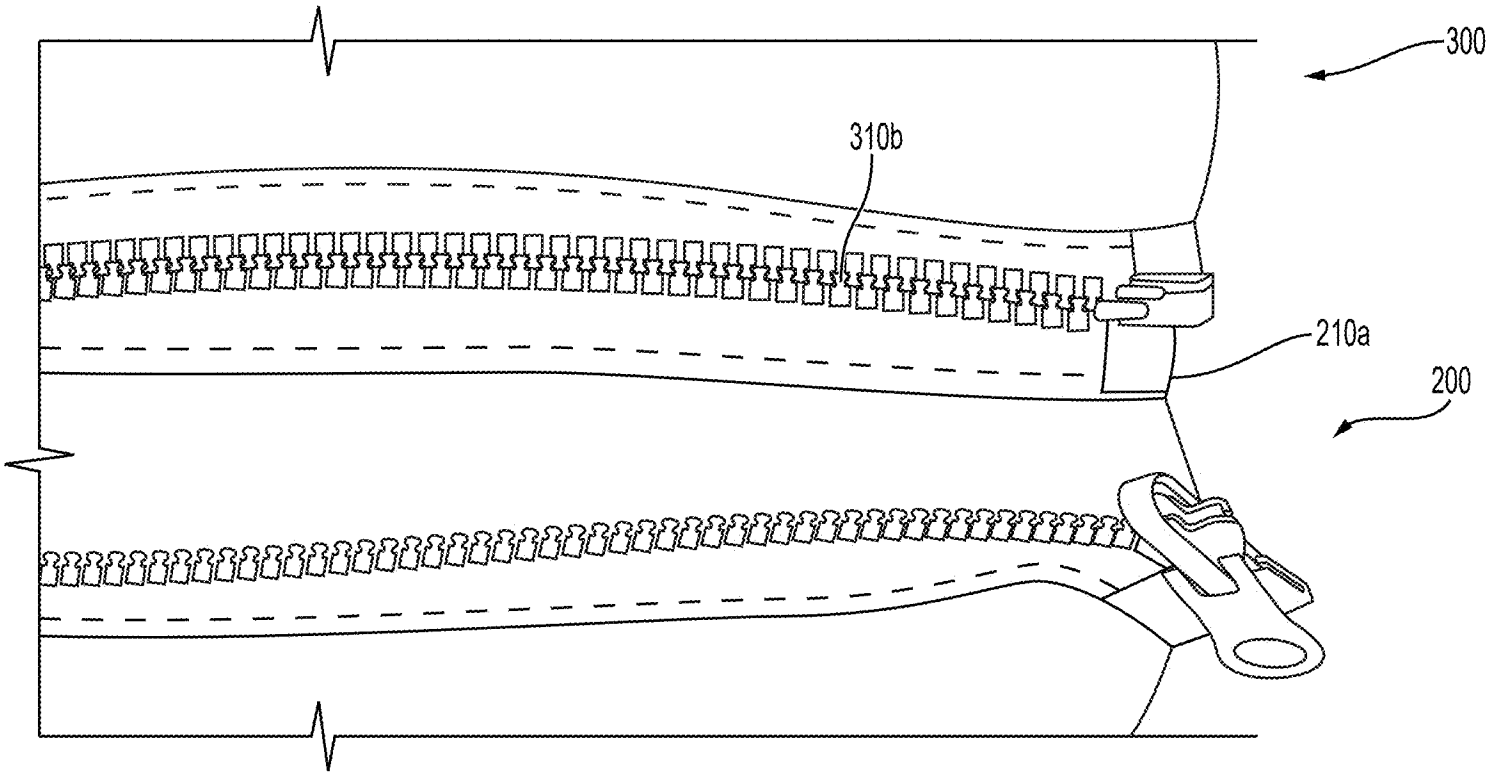
FIG. 7 is an example bedding system with one fastening component track of a sheet fully attached to one fastening component track of a base layer.

FIG. 7 is an example bedding system with one fastening component track of a sheet fully attached to one fastening component track of a base layer. The first track of the engaging component 210*a* (e.g., male zipper track) of the base layer 200 may completely interlock with the second track of the receiving component 310*b* (e.g., female zipper track) of the first sheet 300. Once interlocked, the first track of the engaging component 210*a* (e.g., male zipper track) of the base layer 200 and the second track of the receiving component 310*b* (e.g., female zipper track) may become coplanar, such that their tracks, tape, and teeth are in the same plane.

Figure 8:
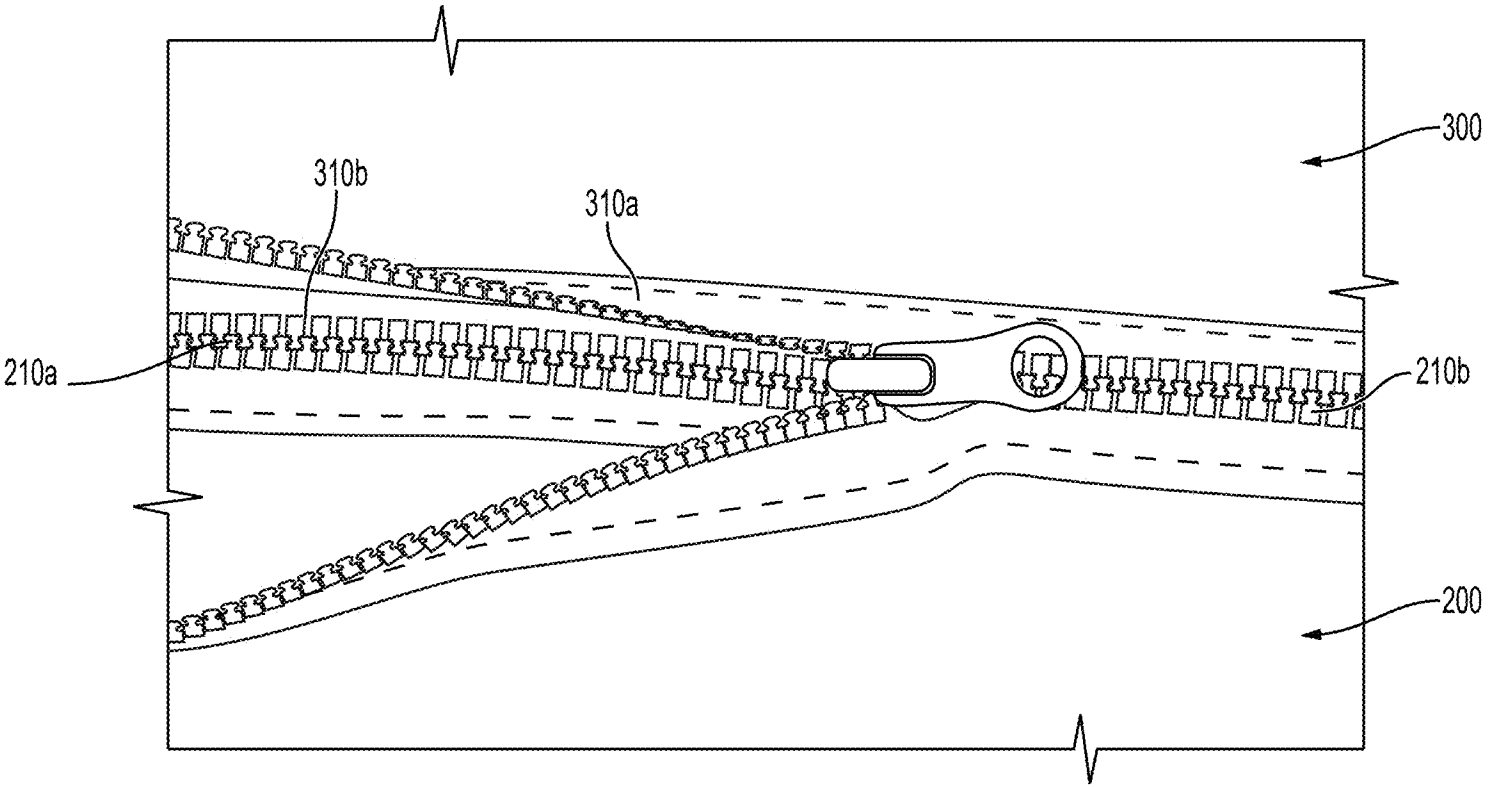
FIG. 8 is an example bedding system with optional tension control between a sheet and a base layer.
Figure 9:
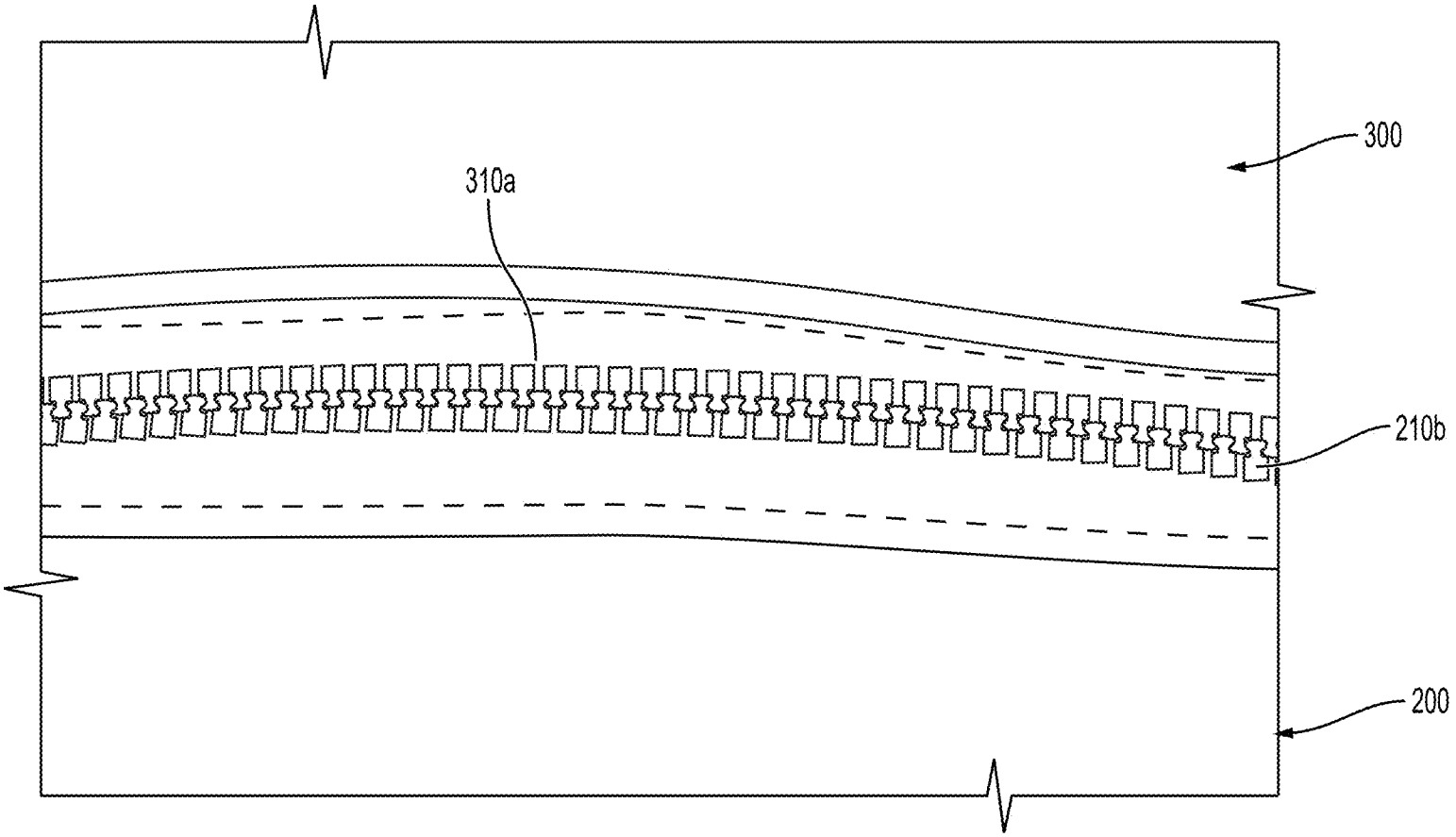
FIG. 9 is an example bedding system with optional tension control between a sheet and a base layer.

FIG. 8 is an example bedding system with optional tension control between a sheet and a base layer partially engaged. The first track of the engaging component 310*a* (e.g., male zipper track) of the first sheet 300 may interlock with the second track of the receiving component 210*b* (e.g., female zipper track) of the base layer 200 to provide tension control between the first sheet 300 and base layer 200 so they are taut. Underneath the interlocked first track of the engaging component 310*a* (e.g., male zipper track) of the first sheet 300 and the second track of the receiving component 210*b*, the first track of the engaging component 210*a* (e.g., male zipper track) of the base layer 200 may be interlocked with the second track of the receiving component 310*b* (e.g., female zipper track) of the first sheet 300. As shown in FIG. 9, there may be two (e.g., two layers of) interlocked zippers. In some examples, the sheet layer may be fastened to the base layer once without tension control. In such cases, there may be one interlocked or closed zipper.

FIG. 9 is an example bedding system with optional tension control between a sheet and a base layer that are fully engaged. The first track of the engaging component 310*a* (e.g., male zipper track) of the first sheet 300 may interlock with the second track of the receiving component 210*b* (e.g., female zipper track) of the base layer 200 to provide tension control between a sheet and base layer so they are taut. When the first track of the engaging component 310*a* (e.g., male zipper track) of the first sheet 300 completely interlock with the second track of the receiving component 210*b* (e.g., female zipper track), the first track of the engaging component 210*a* (e.g., male zipper track) of the base layer 200 being interlocked with the second track of the receiving component 310*b* (e.g., female zipper track) of the first sheet 300 may not be visible. The first track of the engaging component 310*a* (e.g., male zipper track) of the first sheet 300 and the second track of the receiving component 210*b* (e.g., female zipper track) may be coplanar. The first track of the engaging component 210*a* (e.g., male zipper track) of the base layer 200 being interlocked with the second track of the receiving component 310*b* (e.g., female zipper track) may be coplanar.

Figure 10:
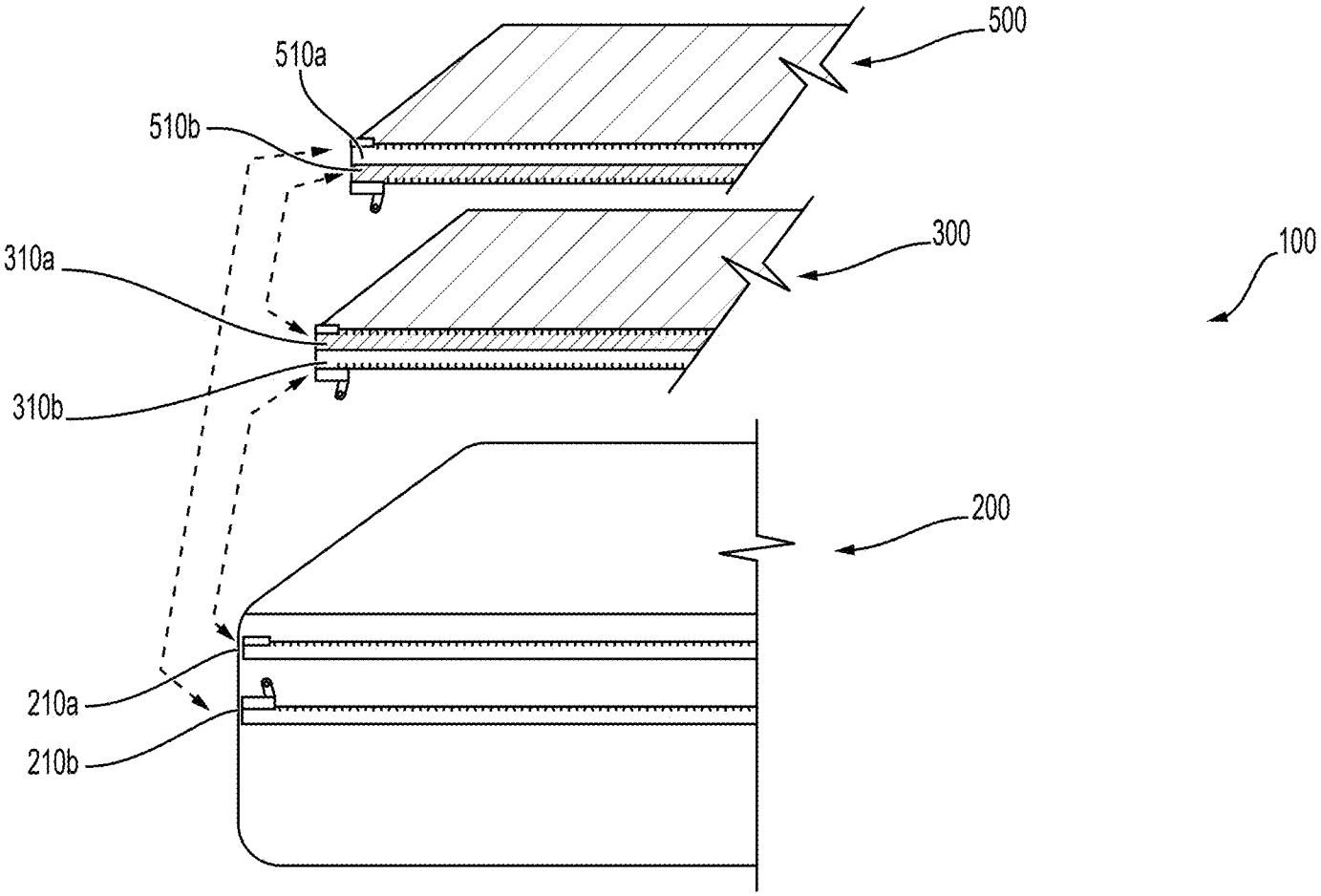
FIG. 10 is an exploded view of an example bedding system with a base layer and two sheet s.

FIG. 10 is an exploded view of an example bedding system with a base layer and two sheet s. Any number of sheets (e.g., 1, 2, 3, 4, 5, 6, 7, 8, 9, 10, 11, 12, 13, 14, 15, 16, 17, 18, 19, 20, etc.) may be attached to or detached from a base layer. In some examples, two sheets may be attached to the base layer. The two tracks of fastening components of different layer(s) or sheet(s) may align so the fastening components of the different layer(s) or sheet(s) can engage with each other to fasten the different layer(s) or sheet(s) together.

Figure 11:
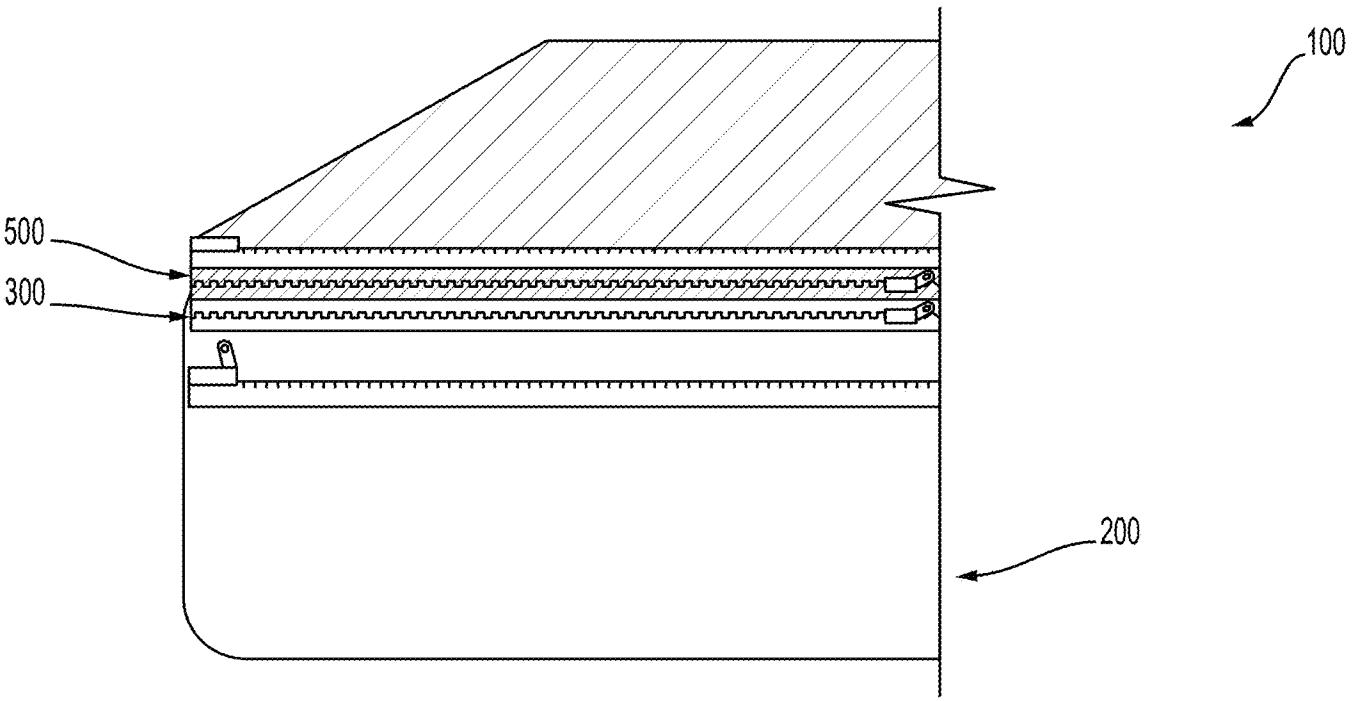
FIG. 11 is a view of an example bedding system with two sheets attached to a base layer.

FIG. 11 is a view of an example bedding system with two sheets attached to a base layer. Sheets (e.g., first sheet 300, second sheet 500) may be attached to the base layer 200 from the top side of the base layer 200. First sheet 300 and second sheet 500 may be stacked or layered onto the base layer 200. First sheet 300 may be attached to the base layer 200 by interlocking their respective fastening components (e.g., respective zipper tracks), such that the bottom surface of the first sheet 300 may contact the top surface of the base layer 200. Specifically, the second track of the receiving component 310*b* of first sheet 300 may engage with the first track of the engaging component 210*a* of base layer 200 to attach the base layer 200 and the first sheet 300. Second sheet 500 may be attached to the first sheet 300 by interlocking their respective fastening components (e.g., respective zipper tracks), such that the bottom surface of the second sheet 500 may contact the top surface of the first sheet 300. Specifically, the second track of the receiving component 510*b* of second sheet 500 may engage with the first track of the engaging component 310*a* of first sheet 300 to attach the first sheet 300 and the second sheet 500. The first track of the engaging component 510*a* may engage with another sheet, such as a third sheet, to maintain additional sheets on the base layer or the base layer for tension control. In some examples, the first track of the engaging component 510*a* does not engage with any other sheet or layer (as shown).

Figure 12:
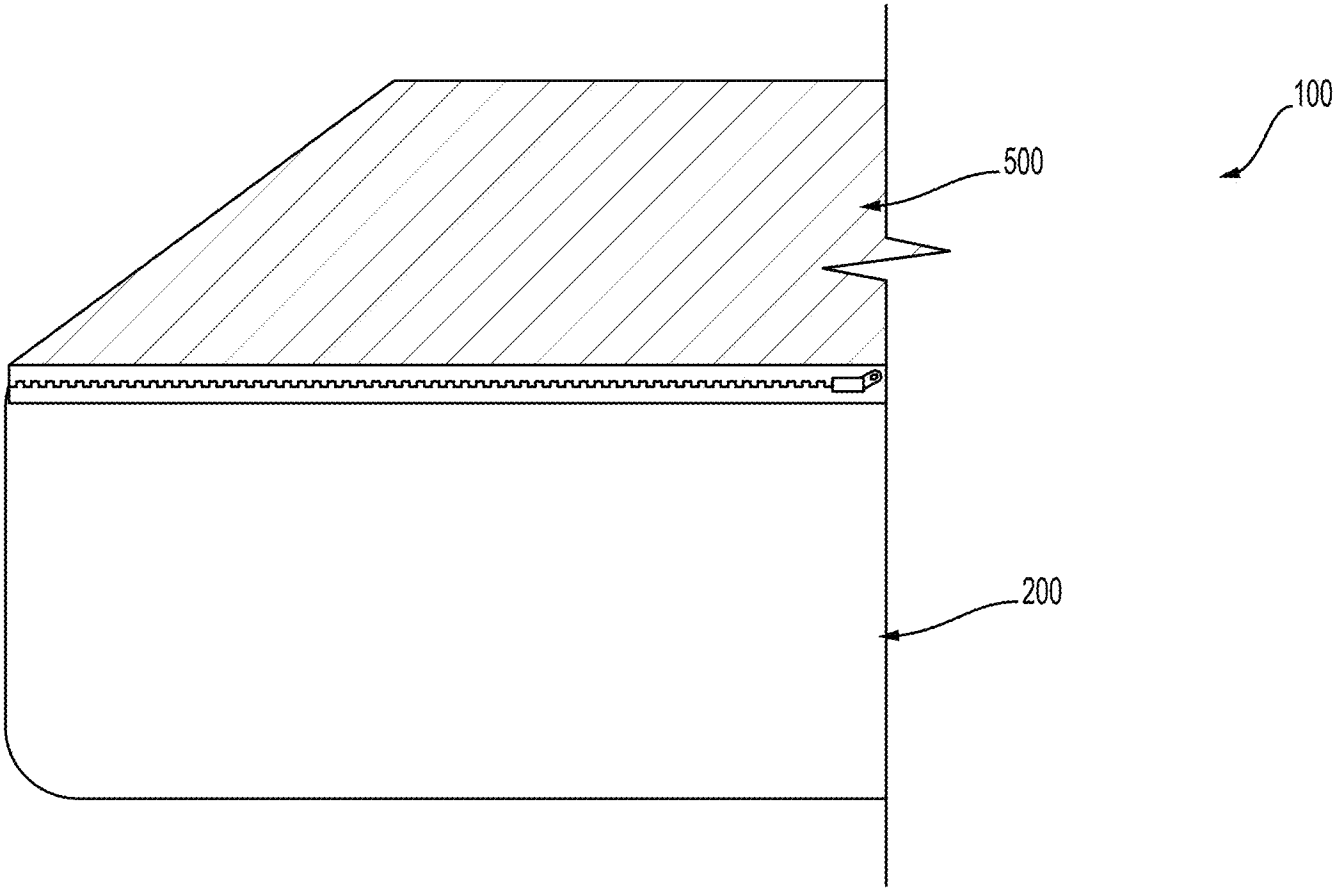
FIG. 12 shows an example bedding system with optional tension control between two sheets and a base layer.

FIG. 12 shows an example bedding system with optional tension control between two sheets and a base layer. For tension control, second sheet 500 may be attached to the base layer 200, such that the first track of the engaging component 510*a* may be engaged with the second track of the receiving component 210*b* of base layer 200. Additional sheets may be placed on sheet 500, and the last sheet or uppermost sheet placed on the stack may be attached to the base layer 200 for tension control.

The base layer 200 and sheets 300, 500 may be made of any material suitable for bedding. The base layer and/or sheets can be made from fabrics of any thread count, such as cotton, polyester, Tencel (lyocell), blends (e.g., cotton-polyester, bamboo-cotton), etc. The base layer and/or sheet can be made waterproof. In some examples, a waterproof material, such as polyurethane laminate (PUL), may be applied to fabric to create a waterproof barrier. In some examples, the base layer and/or sheets may be made of a waterproof material, such as vinyl (PVC) or thermoplastic polyurethane (TPU). Considerations when using materials may include thickness, flexibility, stretchability, breathability, durability, softness, comfort (e.g., hypoallergenic, freshness), noise, maintenance (e.g., machine washable, resistances to stains and odors, quick-drying, wrinkle-resistant), and eco-friendliness. In some examples, the base layer is made of waterproof material and at least one sheet is not made of waterproof material. In some examples, neither the base layer nor any of the sheets are made of waterproof material. In some examples, the base layers and all of the sheets are made of waterproof material.

The base layer and sheets 300, 500 may have other tension-promoting features, such as an extended fabric flap on the sheets 300, 500 that can be tucked under a mattress to provide a more taut surface. The base layer and sheets may be attachable to other bedding components, such as duvet covers, comforters, and blankets.

The base layer 200 may be a mattress cover or a fitted sheet that fits over a mattress. In some examples, the base layer 200 is a mattress that may be of any custom or standard size. Standard-size mattresses may include California king, king, split king, queen, split queen, Olympic queen, full or double, twin XL, twin, etc. A California king mattress may be 72 inches wide by 84 inches long (or approximately 183 cm wide by 213.5 cm long). A king mattress may be 76 inches wide by 80 inches long (approximately 193 cm wide by 203 cm long). A queen mattress may be 60 inches wide by 80 inches long (approximately 152.5 cm wide by 203 cm long). A full or double mattress may be 54 inches wide by 75 inches long (approximately 137 cm wide by 190.5 cm long). A twin XL mattress may be 38 inches wide by 80 inches long (approximately 96.5 cm wide by 203 cm long). A twin mattress may be 38 inches wide by 75 inches long (approximately 96.5 cm wide by 190.5 cm long). A split king or a split queen are standard king or queen mattresses split into two halves, typically used with adjustable beds where each side can be adjusted independently. An Olympic queen mattress may be slightly wider than a standard queen at 66 inches. In some examples, the base layer 200 is a mattress cover or fitted sheet to fit any of the custom or standard-size mattresses. In some examples, the sheets may have dimensions that are 0-10% lesser or greater than the dimensions of the top surface of the base layer.

Figure 13:
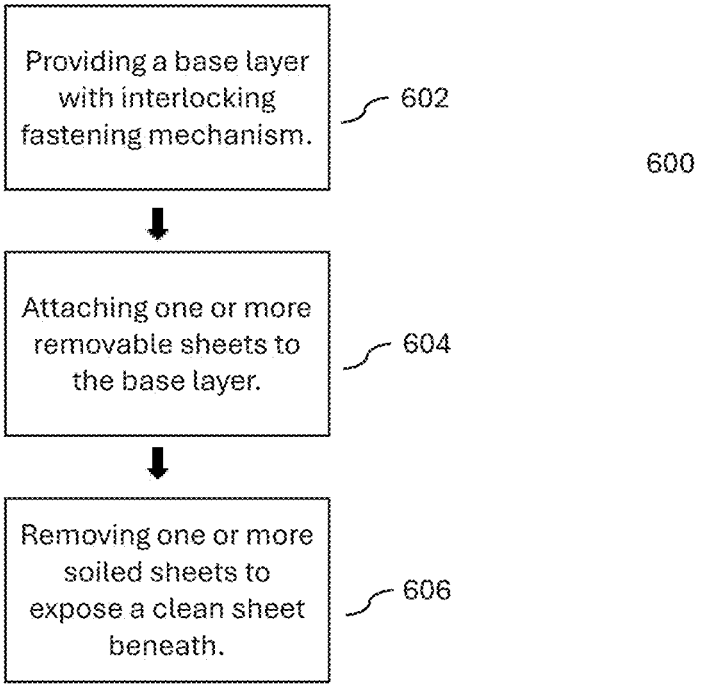
FIG. 13 is a flowchart showing the process of using sheets with a base layer.

FIG. 13 is a flowchart showing the process 600 of using sheets with a base layer. In step 602, a base layer is provided with an interlocking fastening mechanism. In step 604, one or more removable sheets may be attached to the base layer using a fastening mechanism complementary to the interlocking fastening mechanism of the base layer. For tension control, the topmost sheet may be attached to the base layer. In step 606, removing the topmost or one or more soiled sheet(s) for various reasons, such as nighttime accidents, hygiene purposes, or food stains, exposes or reveals a clean sheet underneath.

The following clauses illustrate the example subject matter described herein.

A method of exposing a clean sheet underneath a used sheet from a mattress comprising:

a base layer having a top surface located on a top side of the base layer, at least one lateral surface connected to the top surface of the base layer and extending downwardly from the top surface of the base layer, and a bottom side positioned opposite from the top side of the base layer, two or more tracks of fastening members each disposed on either the top surface or the at least one lateral surface of the base layer, a first sheet having a top surface on a top side of the first sheet, a bottom surface located on a bottom side of the first sheet and positioned opposite from the top surface of the first sheet, at least one lateral surface interposed between the top surface and the bottom surface of the first sheet, two or more tracks of fastening members each disposed on either the top surface, the bottom surface, or the at least one lateral surface of the first sheet, a second sheet having a top surface located on a top side of the second sheet, a bottom surface located on a bottom side of the second sheet and positioned opposite from the top surface of the second sheet, at least one lateral surface interposed between the top surface and the bottom surface of the second sheet, two or more tracks of fastening members each disposed on either the top surface, the bottom surface, or the at least one lateral surface of the second sheet, wherein the base layer is configured to removably attach to the first sheet, the second sheet, or both the first sheet and the second sheet from the top side of the base layer, wherein the first sheet is configured to removably attach to a base layer from the bottom side of the first sheet and a second sheet from the top side of the first sheet, and wherein the second sheet is configured to removably attach to the first sheet from the bottom side of the second sheet and either a third sheet from the top side of the second sheet or the base layer from the bottom side of the second sheet.

wherein the first track of the engaging component of the base layer engages with the second track of the receiving component of the first sheet to form a removable attachment between the base layer and the first sheet, and wherein the first track of the engaging component of the first sheet engages with the second track of the receiving component of the second sheet to form a removable attachment between the first sheet and the second sheet; and disengaging the first track of the engaging of the first sheet from the second track of the receiving component of the second sheet to detach the second sheet from the first sheet to expose the first sheet.

While the disclosure has been described in connection with what is presently considered to be the most practical and preferred embodiments, it is to be understood that the disclosure is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore, it should be understood that while the use of the word preferable, preferably, or preferred in the description above indicates that the feature so described may be more desirable, it nonetheless may not be necessary and any embodiment lacking the same may be contemplated as within the scope of the disclosure, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A layerable bedding system comprising:

a base layer including:

a top surface on a top side of the base layer, at least one lateral surface connected to the top surface and extending downwardly from the top surface, and a bottom side positioned opposite from the top side, the base layer being configured to removably attach to one or more sheets from the top side of the base layer; and two or more tracks of fastening members each disposed on either the top surface or the at least one lateral surface of the base layer, the two or more tracks of fastening members including a first track of an engaging component and a second track of a receiving component, wherein the first track of the engaging component and the second track of the receiving component are each disposed on the at least one lateral surface of the base layer at a position closer to the top surface of the base layer than to the bottom side of the base layer, wherein both the first track of the engaging component and the second track of the receiving component are configured to mate with sheets of the one or more sheets positioned on the top side of the base layer, wherein either:

each of the first track of the engaging component and the second track of the receiving component are configured to mate with different sheets of the one or more sheets positioned on the top side of the base layer, or both the first track of the engaging component and the second track of the receiving component are configured to mate with a single sheet of the one or more sheets positioned on the top side of the base layer.

2. The bedding system of claim 1, wherein the base layer is a mattress cover or a fitted sheet configured to fit over a mattress and wherein the bottom side of the base layer is open.

3. The bedding system of claim 1, wherein the base layer is a mattress and the bottom side of the base layer includes a bottom surface positioned opposite from the top surface, the at least one lateral surface being interposed between the top surface and the bottom surface.

4. The bedding system of claim 1, wherein the first track of the engaging component and the second track of the receiving component are parallel to each other.

5. The bedding system of claim 1, further comprising a third track of an engaging component and a fourth track of a receiving component, wherein the at least one lateral surface includes a first lateral surface positioned opposite from a third lateral surface and a second lateral surface positioned opposite from a fourth lateral surface, wherein the first track of the engaging component and the second track of the receiving component are disposed on the first lateral surface, wherein the third track of the engaging component and the fourth track of the receiving component are disposed on the third lateral surface, and wherein the first track of the engaging component and the third track of the engaging component are configured to mate with a first sheet of the one or more sheets from the top side of the base layer and the second track of the receiving component and the fourth track of the receiving component are configured to mate with a first sheet or a second sheet of the one or more sheets from the top side of the base layer.

6. The bedding system of claim 1, further comprising a third track of an engaging component and a fourth track of a receiving component, wherein the at least one lateral surface includes a first lateral surface positioned opposite from a third lateral surface and a second lateral across positioned opposite from a fourth lateral surface, wherein the first lateral surface has a first length, the third lateral surface has a third length, the second lateral surface has a second length, the fourth lateral surface has a fourth length, each of the first length and the third length being longer than each of the second length and the fourth length, wherein the first track of the engaging component and the second track of the receiving component are disposed on the first lateral surface, wherein the third track of the engaging component and the fourth track of the receiving component are disposed on the third lateral surface, wherein either:

each of the third track of the engaging component and the fourth track of the receiving component are configured to mate with different sheets of the one or more sheets positioned on the top side of the base layer, or both the third track of the engaging component and the fourth track of the receiving component are configured to mate with a single sheet of the one or more sheets positioned on the top side of the base layer, and wherein the first track of the engaging component and the third track of the engaging component are configured to mate with a single sheet of the one or more sheets from the top side of the base layer and the second track of the receiving component and the fourth track of the receiving component are configured to mate with a single sheet of the one or more sheets from the top side of the base layer.

7. The bedding system of claim 1, further comprising a third track of an engaging component, a fourth track of a receiving component, a fifth track of an engaging component, a sixth track of a receiving component, a seventh track of an engaging component, and an eighth track of a receiving component, wherein the at least one lateral surface includes a first lateral surface positioned opposite from a third lateral surface and a second lateral surface positioned opposite from a fourth lateral surface, wherein the first track of the engaging component and the second track of the receiving component are disposed on the first lateral surface, wherein the third track of the engaging component and the fourth track of the receiving component are disposed on the third lateral surface, wherein the fifth track of the engaging component and the sixth track of the receiving component are disposed on the second lateral surface, wherein the seventh track of the engaging component and the eighth track of the receiving component are disposed on the fourth lateral surface, wherein either:

each of the third track of the engaging component and the fourth track of the receiving component are configured to mate with different sheets of the one or more sheets positioned on the top side of the base layer, or both the third track of the engaging component and the fourth track of the receiving component are configured to mate with a single sheet of the one or more sheets positioned on the top side of the base layer, wherein either:

each of the fifth track of the engaging component and the sixth track of the receiving component are configured to mate with different sheets of the one or more sheets positioned on the top side of the base layer, or both the fifth track of the engaging component and the sixth track of the receiving component are configured to mate with a single sheet of the one or more sheets positioned on the top side of the base layer, wherein either:

each of the seventh track of the engaging component and the eighth track of the receiving component are configured to mate with different sheets of the one or more sheets positioned on the top side of the base layer, or both the seventh track of the engaging component and the eighth track of the receiving component are configured to mate with a single sheet of the one or more sheets positioned on the top side of the base layer, and wherein the first track of the engaging component, the third track of the engaging component, the fifth track of the engaging component, and the seventh track of the engaging component are configured to mate with a single sheet of the one or more sheets from the top side of the base layer and the second track of the receiving component, the fourth track of the receiving component, the sixth track of the receiving component, and the eighth track of the receiving component are configured to mate with a single sheet of the one or more sheets from the top side of the base layer.

8. The bedding system of claim 1, wherein the at least one lateral surface includes a first lateral surface, a second lateral surface, a third lateral surface, and a fourth lateral surface that define a perimeter of the base layer, the first track of the engaging component and the second track of the receiving component being disposed continuously along the perimeter of the base layer.

9. The bedding system of claim 1, wherein the engaging component and the receiving component are components of a zipper.

10. The bedding system of claim 1, wherein the first track of the engaging component is positioned closer to the top surface of the base layer than the second track of the receiving component.

11. A bedding system comprising:

a first sheet including:

a top surface located on a top side of the first sheet, a bottom surface located on a bottom side of the first sheet and positioned opposite from the top surface, and at least one lateral surface interposed between the top surface and the bottom surface, the first sheet being configured to removably attach to a base layer from the bottom side of the first sheet; and two or more tracks of fastening members each disposed on either the top surface, the bottom surface, or the at least one lateral surface of the first sheet, wherein the two or more tracks of fastening members includes:

a first track of an engaging component configured to mate with a second sheet from a top side of the first sheet or a base layer from the bottom side of the first sheet, and a second track of a receiving component configured to mate with a base layer from the bottom side of the first sheet, wherein the first track of the engaging component and the second track of the receiving component are each disposed on the at least one lateral surface of the first sheet, wherein the first track of the engaging component is disposed at a position near or on the edge between the at least one lateral surface and the top surface of the first sheet, and wherein the second track of the receiving component is disposed at a position between the first track of the engaging component and the bottom surface of the first sheet, the second track being configured to mate with a base layer from the bottom side of the first sheet.

12. The bedding system of claim 11, wherein the first track of the engaging component and the second track of the receiving component are parallel to each other.

13. The bedding system of claim 11, wherein the at least one lateral surface includes a first lateral surface, and wherein the first track of the engaging component and the second track of the receiving component are disposed on the first lateral surface.

14. The bedding system of claim 11, further comprising a third track of an engaging component and a fourth track of a receiving component, wherein the at least one lateral surface includes a first lateral surface positioned opposite from a third lateral surface and a second lateral across positioned opposite from a fourth lateral surface, wherein the first track of the engaging component and the second track of the receiving component are disposed on the first lateral surface, wherein the third track of the engaging component and the fourth track of the receiving component are disposed on the third lateral surface, and wherein the first track of the engaging component and the third track of the engaging component are configured to mate with a second sheet from the top side of the first sheet or the base layer from the bottom side of the first sheet, and wherein the second track of the receiving component and the fourth track of the receiving component are configured to mate with a base layer from the bottom side of the first sheet.

15. The bedding system of claim 11, wherein the engaging component and the receiving component are components of a zipper.

16. The bedding system of claim 11, wherein the first track of the engaging component is positioned closer to the top surface of the first sheet than the second track of the receiving component.

17. A bedding system comprising:

a base layer including:

top surface located on a top side of the base layer, at least one lateral surface connected to the top surface of the base layer and extending downwardly from the top surface of the base layer, and a bottom side positioned opposite from the top side of the base layer;

two or more tracks of fastening members each disposed on either the top surface or the at least one lateral surface of the base layer;

wherein the two or more tracks of fastening members of the base layer are each disposed on the at least one lateral surface of the base layer at a position closer to the top surface of the base layer than to the bottom side of the base layer, and wherein each of the two or more tracks is configured to mate with one or more sheets positioned on the top side of the base layer;

a first sheet of the one or more sheets including:

a top surface on a top side of the first sheet, bottom surface located on a bottom side of the first sheet and positioned opposite from the top surface of the first sheet, and at least one lateral surface interposed between the top surface and the bottom surface of the first sheet;

two or more tracks of fastening members each disposed on either the top surface, the bottom surface, or the at least one lateral surface of the first sheet;

a second sheet of the one or more sheets including:

a top surface located on a top side of the second sheet, a bottom surface located on a bottom side of the second sheet and positioned opposite from the top surface of the second sheet, and at least one lateral surface interposed between the top surface and the bottom surface of the second sheet; and two or more tracks of fastening members each disposed on either the top surface, the bottom surface, or the at least one lateral surface of the second sheet;

wherein the base layer is configured to removably attach to the first sheet, the second sheet, or both the first sheet and the second sheet from the top side of the base layer, wherein the first sheet is configured to removably attach to the base layer from the bottom side of the first sheet and a second sheet from the top side of the first sheet, and wherein the second sheet is configured to removably attach to the first sheet from the bottom side of the second sheet and either a third sheet from the top side of the second sheet or the base layer from the bottom side of the second sheet.

18. The bedding system of claim 17, wherein the two or more tracks of fastening members of the base layer include a first track of an engaging component and a second track of a receiving component, wherein the first track of the engaging component of the base layer engages with the second track of the receiving component of the first sheet to form a removable attachment between the base layer and the first sheet, and wherein the two or more tracks of fastening members of the first sheet include a first track of an engaging component and a second track of a receiving component, and wherein the first track of the engaging component of the first sheet engages with the second track of the receiving component of the second sheet to form a removable attachment between the first sheet and the second sheet.

19. The bedding system of claim 17, wherein the two or more tracks of fastening members of the base layer include a first track of an engaging component and a second track of a receiving component, wherein the first track of the engaging component of the base layer engages with the second track of the receiving component of the first sheet to form a removable attachment between the base layer and the first sheet, wherein the two or more tracks of fastening members of the first sheet include a first track of an engaging component and a second track of a receiving component, wherein the first track of the engaging component of the first sheet engages with the second track of the receiving component of the second sheet to form a removable attachment between the first sheet and the second sheet, wherein the two or more tracks of fastening members of the second sheet include a first track of an engaging component and a second track of a receiving component, and wherein the first track of the engaging component of the second sheet engages with the second track of the receiving component of the base layer to form a taut removable attachment between the base layer and the second sheet.

20. The bedding system of claim 1, further comprising at least one sheet layer, wherein the at least one sheet layer includes:

a first track of an engaging component configured to removably engage with a complementary receiving component of one of (i) the base layer or (ii) another sheet layer; and a second track of a receiving component configured to removably receive an engaging component of another sheet layer from the top surface of the base layer;

wherein the at least one sheet layer is configured to selectively function as both (i) an uppermost sheet layer and (ii) an intermediate sheet layer disposed between the base layer and another sheet layer;

wherein the first track and the second track are arranged such that each sheet layer is capable of being repeatedly and removably coupled in a stacked configuration with a plurality of sheet layers without requiring a direct attachment to the base layer; and wherein the bedding system is configured to permit a variable number of sheet layers to be removably stacked in a recursive manner by successive engagement of the first track of one sheet layer with the second track of another sheet layer.

* * * * *